US006860586B2

(12) United States Patent
Ishikura

(10) Patent No.: US 6,860,586 B2
(45) Date of Patent: Mar. 1, 2005

(54) IMAGE FORMING APPARATUS OF INK-JET TYPE AND IMAGE FORMING METHOD OF INK-JET TYPE

(75) Inventor: Hiroyuki Ishikura, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 282 days.

(21) Appl. No.: 09/949,931

(22) Filed: Sep. 12, 2001

(65) Prior Publication Data

US 2002/0030717 A1 Mar. 14, 2002

(30) Foreign Application Priority Data

Sep. 12, 2000 (JP) ..... 2000-277188

(51) Int. Cl.[7] ..... B41J 2/21
(52) U.S. Cl. ..... 347/43; 347/15; 347/41
(58) Field of Search ..... 347/15, 41, 43, 347/16

(56) References Cited

U.S. PATENT DOCUMENTS

| | | | | |
|---|---|---|---|---|
| 5,614,931 A | | 3/1997 | Koike et al. | |
| 5,767,876 A | | 6/1998 | Koike et al. | |
| 5,798,776 A | | 8/1998 | Uchiyama, deceased et al. | |
| 5,933,577 A | | 8/1999 | Naitoh et al. | |
| 6,244,687 B1 | * | 6/2001 | Gast et al. | 347/43 |
| 6,273,550 B1 | * | 8/2001 | Brown | 347/43 |

FOREIGN PATENT DOCUMENTS

| | | | | |
|---|---|---|---|---|
| EP | 0955174 | * | 10/1999 | 347/43 |
| JP | 02-026753 | | 1/1990 | |
| JP | 04-173250 A | | 6/1992 | |
| JP | 7195715 | | 8/1995 | |
| JP | 08-300694 A | | 11/1996 | |
| JP | 10-100413 A | | 4/1998 | |
| JP | 11216882 | | 8/1999 | |
| JP | 11-320926 A | | 11/1999 | |
| JP | 2001-096770 A | | 4/2001 | |
| JP | 2001-205828 A | | 7/2001 | |
| JP | 2001-232826 A | | 8/2001 | |
| JP | 2001-260394 A | | 9/2001 | |

* cited by examiner

*Primary Examiner*—Lamson Nguyen
(74) *Attorney, Agent, or Firm*—Birch, Stewart, Kolasch & Birch, LLP

(57) ABSTRACT

An image forming apparatus of an ink-jet type of the present invention is provided with an ink head section having a carriage that is composed of a plurality of ink head and scans so as to print. The ink head section is provided with black ink heads and a color ink head in such a manner that the black ink heads sandwich the color ink head. This eliminates the difference in blackness in printing, even if the carriage scans in two ways so as to print. Meanwhile, the ink heads are increased in number only by one, thereby limiting an increase in cost. In short, without a large increase in cost, it is possible to provide an image forming apparatus that forms a high-quality image, while printing time is shorted since the printing is carried out in two ways in a scanning direction.

12 Claims, 11 Drawing Sheets

IMAGE FORMING APPARATUS OF INK-JET TYPE AND IMAGE FORMING METHOD OF INK-JET TYPE

FIELD OF THE INVENTION

The present invention relates to an image forming apparatus of an ink-jet type, for example, a color ink-jet printer, and an image forming method of an ink-jet type.

BACKGROUND OF THE INVENTION

An image forming apparatus of an ink-jet type (hereinafter, it may be called an ink-jet image forming apparatus), for example, an ink-jet printer, has such a simple constitution that allows the apparatus to be miniaturized, while keeping manufacturing cost of the apparatus low. Moreover, the ink-jet image forming apparatus forms an image by jetting liquid ink droplets from a nozzle. Here, the ink droplets are directly absorbed and adhered onto a recording medium, such as paper, a film, and cloth, thus requiring no further processing. Therefore, a color image can be easily formed by using a color ink.

However, it is important for the ink used in the image formation by the ink-jet image forming apparatus that the ink can penetrate into the recording medium and is able to dry on the recording medium. As the ink used in the image formation by the ink-jet image forming apparatus, pigment-based ink and dye-based ink are mainly used. It is well known that the pigment-based ink is inferior to the dye-based ink, in terms of drying and penetrating properties, but the pigment-based ink is better than the dye-based ink in terms of the coloring and color thickness.

For example, recording paper, which is especially for use of the ink-jet printer (recording paper for the ink-jet printer), may be used in order to form an image by the ink-jet image formation apparatus. This can form an image free from color-mixing and bleeding even if printing is carried out with a pigment-based black ink, which is inferior in terms of the penetrating and the drying properties. This is because the recording paper for the ink-jet printer has been subjected to treatments to improve its absorbing and fixing properties with respect to the ink adhered on the recording paper. But, this leads to a higher recording medium cost. If common photocopying paper is used as the recording medium in order to reduce the cost of the recording medium, use of an ink having inferior drying and penetrating properties results in such printing that ink droplets adjacently adhered on the recording medium are merged together, thereby causing the mixing of colors and bleeding. Especially in a region where a color dot area and a block dot area border on each other, black lines and characters becomes indistinct due to the mixing of colors and bleeding.

To solve the forgoing problems, Japanese Un-Examined Patent Application, Tokukaihei, No. 7-149036 (published on Jun. 13, 1995) and Japanese Un-Examined Patent Application, Tokukaihei, No. 8-197831 (published on Aug. 6, 1996) disclose prior arts in which results of printing of the pigment-based black ink having the drying and penetrating properties of, which has the inferior drying and penetrating properties, are improved (a) by printing the black ink so as to overlap on the color ink, which has a superior penetrating property, and (b) by lowering a density of black dots in an image region, so as to make a gap between the black dots so as to print a dot of a color ink in the gap. Those prevent the mixing of colors, the bleeding, improper printing due to rubbing on the recording medium before the ink is dried, and staining between the black ink and the color ink.

However, in case the black ink and the color ink are overprinted by using an ink head section that has a conventional ink head arrangement (an arrangement having a black ink head in ends of an order, for example, an arrangement shown in FIG. 11, where a black ink head (K), a cyan ink head (C), a magenta ink head (M) and a yellow ink head (Y) are disposed in this order, or an arrangement shown in FIG. 12, in which a cyan ink head (C), a magenta ink head (M), a yellow ink head (Y), and a black ink head (K) are placed in this order), the black ink and the color inks are printed in different orders, depending on in which way the ink head section scans (that is, depending on the scanning direction of the ink head section). For this reason, an image formed in this manner has "blackness" (coloring) of black color that looks different depending in which way the ink head section scans. In a region where inks are printed in one way of the scanning direction, the black ink is printed on the color ink, while the color ink is printed on the black ink in a region printed in the other way of the scanning direction. Therefore, if printing is carried out by the ink head section, which has the conventional ink head arrangement, scanning in the two ways of the scanning direction, the blackness in a printed black image is different between the respective ways of the scanning direction of the ink head section. The difference of the blackness causes a problem of deterioration of image quality.

On the other hand, it seems that the foregoing problem is not caused when the density of the black dots in the black image area is lowered so as to make a gap between the black dots of the black ink, so that the color dot of the color ink can be printed in the gap, that is, the printing is carried out in such a manner that the black ink and the color ink are printed adjacent to each other, even if the ink head section having the conventional ink head arrangement is used.

However, in reality, both the black ink and the color ink penetrate and spread into the recording medium. Thus, different blackness of the black image is caused depending on whether the black ink is printed before the color ink or after the color ink, just like the case where the black ink and the color ink are overprinted. Therefore, the quality of the image is deteriorated when the printing is carried out by the ink head section, which is in the conventional arrangement and scans in two ways, even if the density of the black dot is reduced so as to make the gap between the black dots of the black ink so that the color dot of the color ink can be printed in the gap.

Therefore, it is necessary to fix the order of the black ink and the color inks to be printed in each scan of a carriage, in order to have no difference in the blackness of the black printing. But, with the ink head section having the conventional ink head arrangement, the printing must be carried out only in one way of the scanning direction in order to fix the order of the ink. For this reason, the printing cannot be performed in the two ways in the scanning direction, and the printing time cannot be shortened.

Moreover, Japanese Un-Examined Patent Application, Tokukaihei, No. 7-195715 (published on Aug. 1, 1995) and Japanese Un-Examined Patent Application, Tokukaihei No. 11-216882 (published on Aug. 10, 1999) disclose how to shorten the printing time while maintaining the image quality. According to the two applications, a specific ink head arrangement (for example, an arrangement shown in FIG. 17) can fix the order of the inks to print, even if the printing is carried out in the two ways in the scanning direction in an ink-jet image forming apparatus, thereby making it possible to form an image with no difference in the blackness between each scan of the carriage.

However, if the prior arts recited in the two applications are combined together, the ink heads increases in number from 4 to 6 or 7 (this means the number of ink heads is almost doubled), thereby resulting a higher cost. Thus, it is hard to apply those prior arts in an ink-jet image forming apparatus having a low price.

SUMMARY OF THE INVENTION

The present invention has an object to provide an ink-jet image forming apparatus and an ink-jet image forming method that shorten printing time by printing in two ways in scanning direction without increasing cost, and form a high-quality image having no difference in blackness in a black image.

In order to achieve the above object, an image forming apparatus of an ink-jet type of the present invention, which includes an ink head section whose carriage to scan for printing is composed of a plurality of ink heads, wherein the ink heads include black ink heads and a color ink head in such a manner that the black ink heads sandwich the color ink head with respect to the scanning direction.

With the above arrangement, an order of the inks to be printed is so fixed that the black ink, a color ink and the black ink are printed in this order, even if the printing is carried out by the carriage scanning in the two ways in the scanning direction. As a result, each scan of the carriage has (a) an equal area of regions in which the black ink is exposed on the surface of the recording medium and (b) an equal area of regions where the black ink and the color ink are overprinted, no matter which way in the scanning direction the carriage scans, thereby eliminating the difference in the blackness in the printing. Moreover, in terms of a number of the ink heads of the carriage, the ink heads in the above arrangement are increased only by one, compared with the number of the ink heads in the carriage of the conventional image forming apparatus, which can print by the ink head section scanning only in one way in the scanning direction. Therefore, an increase in a manufacturing cost due to the increase in the number of the ink heads is limited, thereby allowing the above arrangement to be used in a large variety of image forming apparatuses. In short, it is possible to provide an image forming apparatus that can form a high-quality image in which the printing time is shortened by printing in the two ways in the scanning direction, without increasing the cost significantly.

Moreover, in order to achieve the above object, an image forming method of an ink-jet type of the present invention in which a carriage, which has an ink head sections composed of a plurality of ink heads, scans for printing, wherein the ink head section includes black ink heads and a color ink head in such a manner that the black ink heads are disposed so as to sandwich the color ink head, so that the ink head section prints a black ink, a color ink, and black ink in this order.

With the above arrangement, even if the printing is carried out by the carriage scanning in the two ways in the scanning direction, the printing is performed in the this order of the inks, so that each scan of the carriage has (a) an equal area of the regions in which the black ink is exposed on the surface of the recording medium and (b) an equal area of the regions where the black ink and the color ink are overprinted, in the image formed on the recording medium, thereby eliminating the difference in the blackness in the printing. Therefore, it is possible to form a high-quality image in which the printing time is shortened by printing in the two ways in the scanning direction.

For a fuller understanding of the nature and advantages of the invention, reference should be made to the ensuing detailed description taken in conjunction with the accompanying drawings.

DESCRIPTION OF THE EMBODIMENTS

Described below are embodiments of the present invention, with reference to FIGS. 1 through 16.

Figure 1:
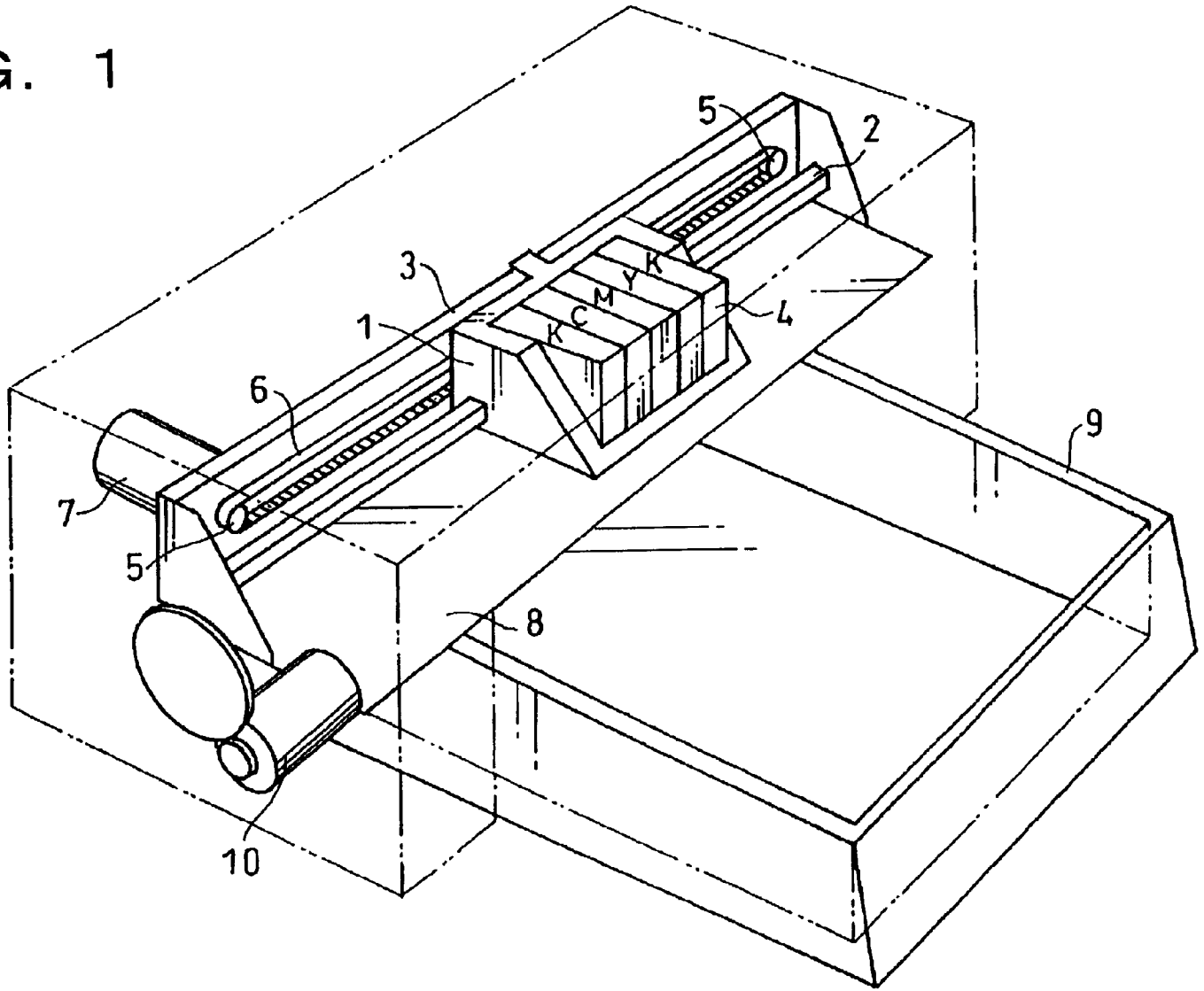
FIG. 1 is a perspective view showing an ink-jet printer in accordance with an embodiment of an ink-jet image forming apparatus of the present invention.

As shown in FIG. 1, a scanning section of an ink-jet printer, as an ink-jet image forming apparatus of one of the embodiments, is provided with a carriage 1. The carriage 1 is supported by a shaft 2 and a guide rail 3, so that the carriage 1 can be freely slid along scanning direction, which is along an axis of the shaft 2. Moreover, the carriage 1 is provided with ink heads, which respectively supply one color independently, namely: a black ink head (K), a cyan ink head (C), a magenta ink head (M), a yellow ink head (Y), and a black ink head (K). Those ink heads are arranged in this order, and parallel to the scanning direction of the carriage 1, thereby constituting an ink head section 4. Here, an order of C, M, and Y is not limited to the order mentioned above. In short, in the ink head section 4, a pair of the black ink heads are arranged, with respect to the scanning direction, so as to sandwich the ink heads (C, M, Y) of other colors. It is not shown here, but respective ink heads (K, C, M, Y, K) are provided with a plurality of nozzles disposed in a single or several lines in a direction crossing the scanning direction of the carriage 1 at a right angle. Furthermore, the respective ink heads (K, C, M, Y, K) have an identical arrangement, except the colors of inks, and characteristics of the nozzles in accordance with the colors.

Furthermore, the carriage 1 is provided with position detecting means (not shown). The position detecting means detects a position of printing on a recording medium or a scanning range as the carriage 1 is moved, and outputs a positional signal to an apparatus that outputs image data, such as a computer and the like. In accordance of the positional signal, the computer and the like determines the printing position, the scanning range or the scanning direction. Then, a nozzle is selected in accordance with the output of the image data from the computer and the like, and ink droplets are jetted out so as to print and form an image on the recording medium.

The carriage 1 is connected to a belt 6 that is stretched between two belt pulleys 5. One of the belt pulleys 5 is connected to a driving motor 7 so that the belt pulley 5 is rotated by the driving motor 7 so as to move the carriage 1 in the scanning direction via the belt 6. The driving motor 7 is driven in both forward or backward directions in accordance with the positional signal to control the scanning direction of the carriage 1. This allows the carriage 1 to be slid freely so as to reciprocate in the two ways in the scanning direction.

Moreover, the ink-jet printer is provided with a platen 8 in the carriage 1 having the ink head section 4. The platen 8 is placed so as to face the nozzles provided to each ink head (K, C, M, Y, K), while keeping a certain gap between the platen 8 and the nozzles. A recording medium, such as paper, film and the like, is supplied from a paper cartridge 9, and then is fed into the platen 8 by a carrying roller 10, so as to be placed on the platen 8. In addition, the recording medium to be placed on the platen 8 is so positioned that the recording medium faces to the nozzles disposed in each ink head. The recording medium placed on the platen 8 is transported by the carrying roller 10, through between the carriage 1 and the platen 8 (that is, the recording medium is fed in), in accordance with timing of printing. Then, ink droplets are jetted out of the nozzles of each ink head disposed in the ink head section 4 of the carriage 1, so as to print on the recording medium passing through the platen 8.

Figure 2:
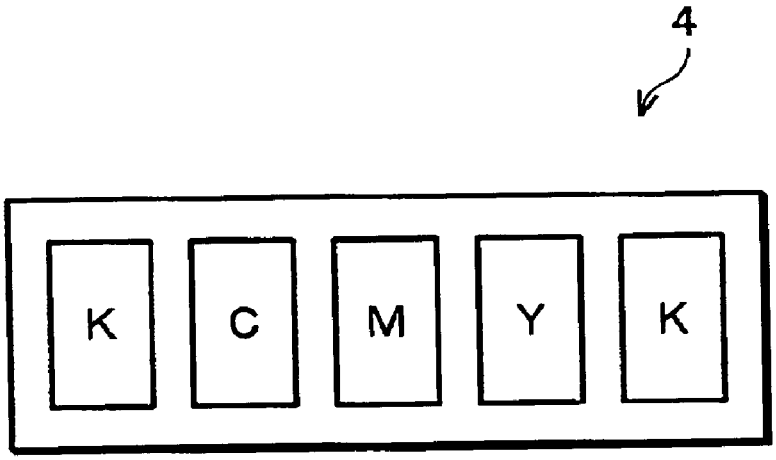
FIG. 2 is a schematic plan view illustrating how ink heads are arranged in an ink head section of the ink-jet printer shown in FIG. 1.

Explained below is a case where the carriage 1 is provided with the ink head section 4 having an arrangement in which the ink heads, a black ink head (K), a magenta ink head (M), a cyan ink head (C), a yellow ink head (Y), and a black ink head (K), are arranged in this order, as shown in FIG. 2, and is used to print on a recording medium to form a black image. Here, a black ink having inferior drying and penetrating properties, and color inks having superior drying and penetrating properties, are overprinted on each other, so as to improve the result of printing of the black ink in terms of the drying and penetrating property.

Hereinafter, a direction, in which the black ink head (K) and the yellow ink head (Y) are respectively first and second in the order of the ink heads in the ink head section of the carriage 1, is refereed to as a direction ①, and a direction, opposite to the direction ①, and where the black ink head (K) and the cyan ink head (C) are respectively first and second in the order of the ink heads in the ink head section of the carriage 1, is called as a direction ②.

When the carriage 1 scans in the direction ① so as to perform the printing, (1) a black ink is printed, first, then (2) a mixed color of a yellow ink, a magenta ink, and a cyan ink, is printed (that is, those three colors are printed in this order), and (3) a black ink is printed again, so as to form the black image. Moreover, in case the carriage 1 scans in the direction ② for printing, the mixed color of the cyan ink, the magenta ink, and the yellow ink, is printed (that is, those three colors are printed in this order) after the black ink is printed, then, the black ink is printed again, so as to form the black image. Note that, "printing the mixed color" means the respective color inks are overprinted on each other. Here, the cyan ink, the magenta ink and the yellow ink are overprinted on each other.

Figure 3:
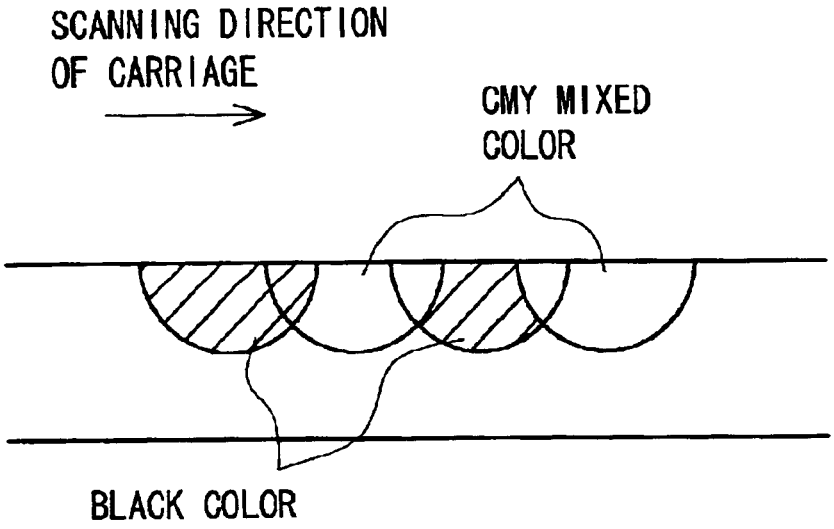
FIG. 3 is a cross-sectional view of a recording medium, illustrating how inks penetrate into the recording medium when the printing is carried out by a carriage, which is provided with an ink head section having the arrangement of the ink heads shown in FIG. 2, scanning in such a way in a scanning direction that a black ink head and a yellow ink head are first and second in an order of the ink heads.
Figure 4:
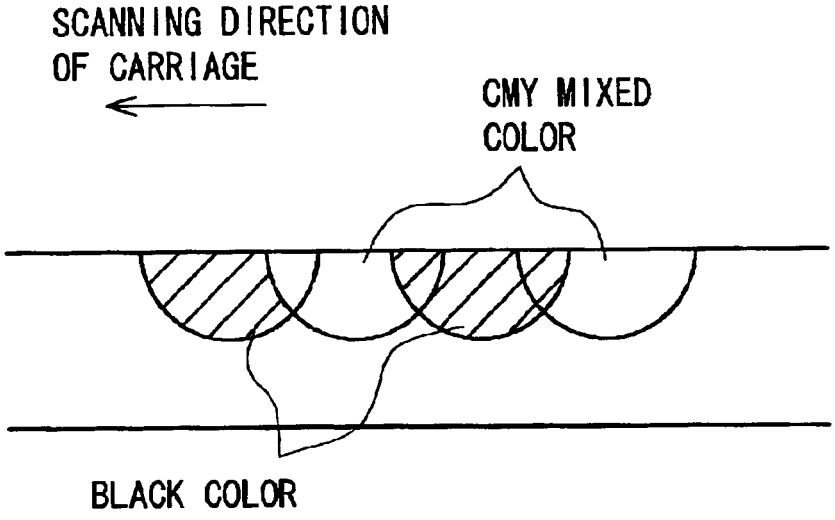
FIG. 4 is a cross-sectional view of a recording medium, illustrating how inks penetrate into the recording medium when the printing is carried out by a carriage, which is provided with an ink head section having the arrangement of the ink heads shown in FIG. 2, scanning in such a way in the scanning direction that a black ink head and a cyan ink head are first and second in an order of the ink heads.

Here, FIG. 3 shows how the inks penetrate into the recording medium when the printing is carried out by the carriage 1 scanning in the direction ①. Meanwhile, FIG. 4 illustrates how the inks penetrate into the recording medium when the printing is carried out by the carriage 1 scanning in the direction ②. As shown in FIGS. 3 and 4, even though the inks are overprinted in a different manner depending on in which way the carriage 1 scans in the scanning direction, the black ink (shaded portions in FIGS. 3 and 4) and the mixed color of the color inks substantially overlap on each other in the same manner in each scan of the carriage, that is, degrees of overlapping (overlapping ratios) is same in each scan of carriage, no matter which way the carriage scans in the scanning direction.

Figure 5:
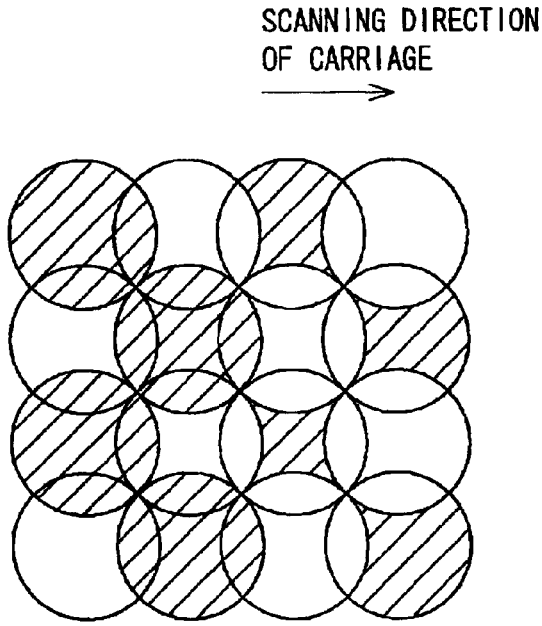
FIG. 5 is a plan view of a recording medium, illustrating a condition of the ink on a surface of the recording medium when the printing is carried out by a carriage, which is provided with an ink head section having the arrangement of the ink heads shown in FIG. 2, scanning in the way in the scanning direction that a black ink head and a yellow ink head are first and second in the order of the ink heads.
Figure 6:
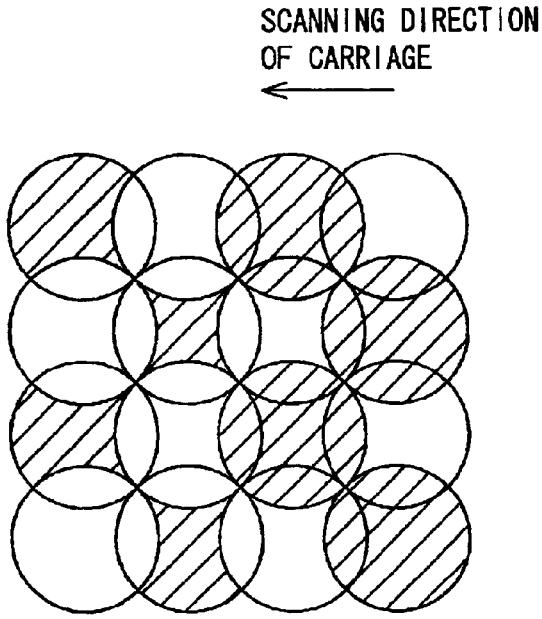
FIG. 6 is a plan view of a recording medium, illustrating a condition of the ink on a surface of the recording medium when the printing is carried out by a carriage, which is provided with an ink head section having the arrangement of the ink heads shown in FIG. 2, scanning in the way in the scanning direction that a black ink head and a cyan ink head are first and second in an order of the ink heads.

FIG. 5 shows a condition of the ink on a surface of the recording medium when the inks penetrate the recording medium as shown in FIG. 3. Moreover, FIG. 6 shows a condition of the ink on a surface of the recording medium when the inks penetrate the recording medium as shown in FIG. 4. When FIGS. 5 and 6 are compared, it is understood that, according to the way the carriage scans in the scanning direction, the mixed color of the color inks is printed on the black ink in different positions, but areas of a region, where the black ink and the color inks overlap, are same in both FIGS. 5 and 6. Moreover, areas of regions in which the black ink is exposed on the surface of the recording medium are same. Therefore, with respect to the whole image, it is possible to eliminate a difference in blackness in the region where the black ink and the color inks are overprinted.

Therefore, in case the arrangement of the present embodiment is employed in the ink head section 4, as discussed above, even if the carriage 1 scans in two ways in the scanning direction so as to perform printing, it is possible to form a high-quality black image without having a difference in the blackness between each scan of the carriage in the formed image. Furthermore, the scanning the carriage 1 in two ways in the scanning direction shortens printing time.

Figure 7:
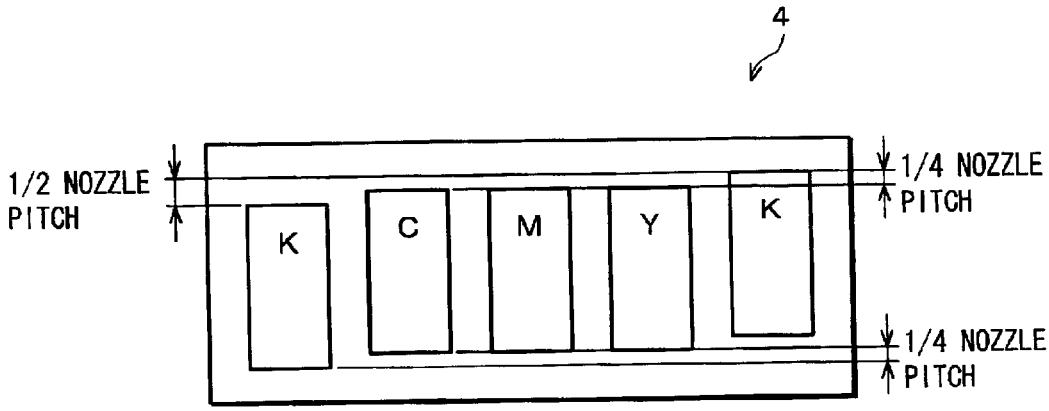
FIG. 7 is a schematic plan view showing how ink heads are arranged in an ink head section of another embodiment of the present invention.
Figure 8:
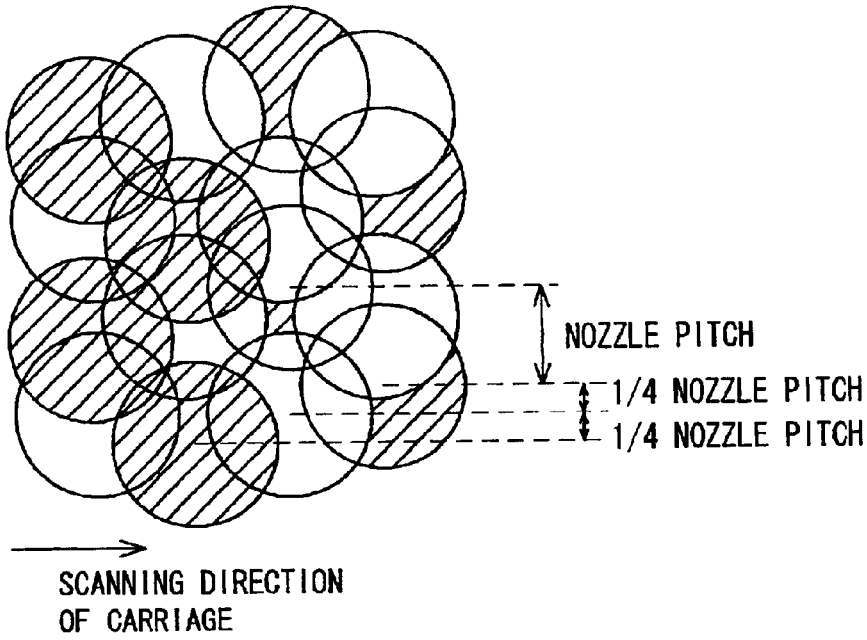
FIG. 8 is a plan view of a recording medium, illustrating a condition of the inks on a surface of the recording medium when the printing is carried out by a carriage, which is provided with an ink head section having the arrangement of the ink heads shown in FIG. 7, scanning in such a way in a scanning direction that a black ink head and a yellow ink head are first and second in an order of the ink heads.
Figure 9:
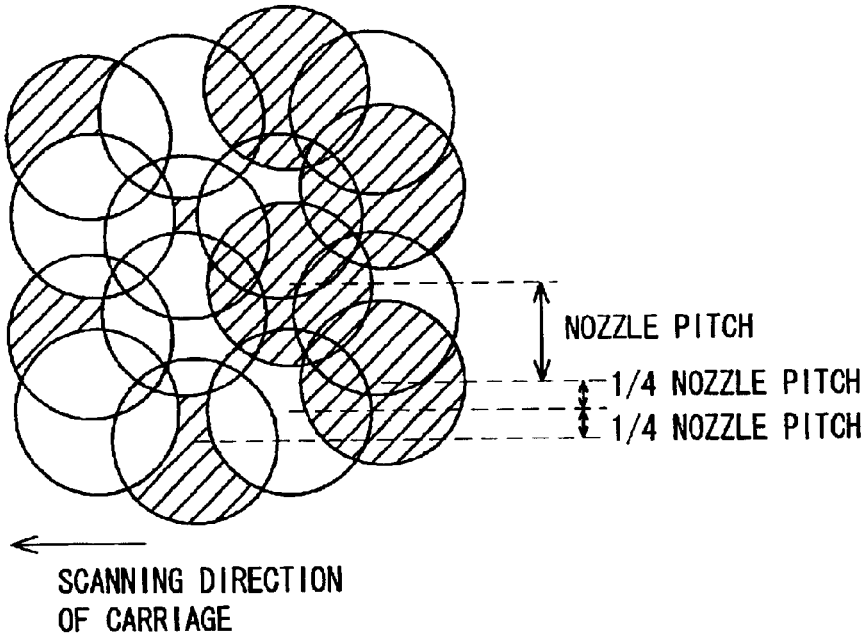
FIG. 9 is a plan view of a recording medium, illustrating a condition of the inks on a surface of the recording medium when the printing is carried out by a carriage, which is provided with an ink head section having the arrangement of the ink heads shown in FIG. 7, scanning in such a way in a scanning direction that a black ink head and a cyan ink head are first and second in an order of the ink heads.

Moreover, as shown in FIG. 7, in an ink head section 4, it is also possible to dispose the black ink heads (K) in positions shifted from the position of the color ink heads (C, M, Y) as much as ¼ of a nozzle pitch, respectively in opposite ways in a direction the recording medium is fed, that is, a direction vertical to the scanning direction of the carriage 1 (in short, the nozzles associated with the black ink heads (K) are also shifted in the same manner). When a black image is formed by using the ink head section 4 having the above arrangement, as shown in FIGS. 8 and 9, the black ink is printed on the mixed color so that different part of the dot of the mixed color is covered with the black ink, and the mixed color is printed on the black ink so that different part of the dot of the black color is covered with the mixed color, compared with the case where nozzles are not shifted. However, the areas of the regions where the black ink is exposed on the surface of the recording medium, and the areas of the regions where the color inks are overprinted on the black ink, are same, no matter which way the carriage 1 scans in the scanning direction. Therefore, it is possible to form a high-quality black image without having a difference in the blackness between each scan of the carriage in the formed image, just like the case where the black ink heads (K) are not shifted. Furthermore, the two black ink heads are respectively shifted in the vertical direction to the scanning direction of the carriage 1, so as to have a distance, which is equivalent to ½ of a nozzle pitch, between respective the black ink heads. Therefore, formed in each scan of the carriage is a black image having resolution, which can be described that the resolution is equivalent to twice the nozzle pitch of the black ink heads, with respect to the vertical direction (the direction the recording medium is fed) to the scanning directions.

Figure 10:
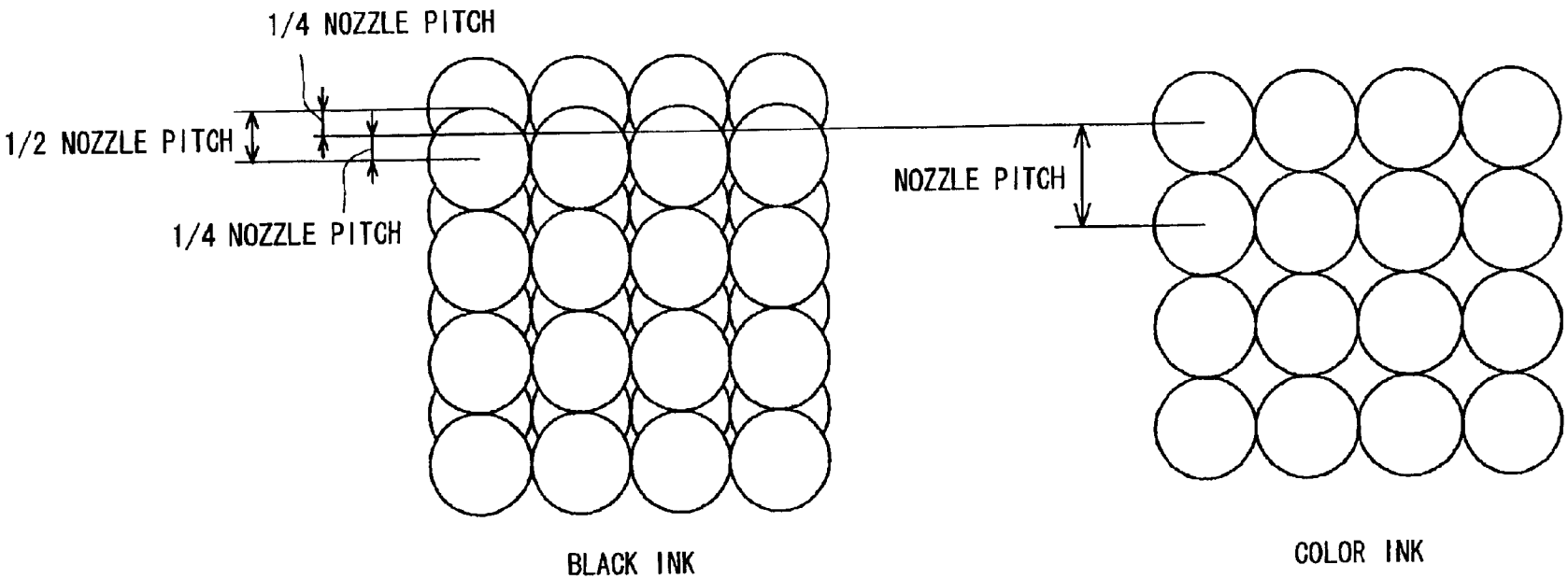
FIG. 10 is a plan view of an image of black printing carried out by using the carriage provided with the ink head section having the arrangement of the ink heads showing in FIG. 7.

As shown in FIG. 10 as an example, in the formed image, the dot of the black ink is so printed that the black ink dot is shifted as much as ½ of the nozzle pitch from the position where the dot of one of the color ink is printed. Therefore, with respect to the feeding direction of the recording medium, the formed image attains resolution that can be described that the resolution is twice better than that of an image having the black inks without such shifting. In short, if an ink head has a nozzle pitch of 600 dpi, attained is the black image having resolution of 1200 dpi.

With the above arrangement of the ink-jet printer, it is possible to have the constant order of inks to print: the black ink, the color inks, and the black ink, even if the printing is carried out by the carriage 1 scanning in the two ways of the scanning direction. As a result, each scan of the carriage has the equal areas of the regions where the black ink is exposed on the surface of the recording medium, and the equal areas of the regions where the black ink and the color ink are overprinted, thereby eliminating the difference in blackness in the printing. Moreover, compared with the conventional ink-jet printer which can scan only in one way to print, the above arrangement has the ink heads increased only by one. Thus, the increase in the cost is not so large, and the arrangement can be employed in various ink-jet printers. In short, without a large increase in cost, the printing time is shortened by printing in the two ways, and a high-quality image is formed.

Moreover, with the above arrangement of the ink-jet printer, it is possible to print the black inks on the recording medium in such a manner that, in each scan of the carriage, the black inks are printed in positions respectively shifted from the position where the color inks are printed, in opposite ways in the vertical direction with respect to the scanning direction. This improves the resolution of the black image formed on the recording medium. Thus, it is possible to form the high-quality image having high resolution. Moreover, with the above arrangement of the ink-jet printer, more black ink, which can be described that the black ink is twice as much as the nozzle pitch, is printed on the recording medium in the positions respectively shifted from the positions, where the color inks are printed, in opposite ways in the direction vertical to the scanning direction. Therefore, formed on the recording medium is a black image having resolution, which can be described that the resolution is equivalent to twice the nozzle pitch.

Figure 11:
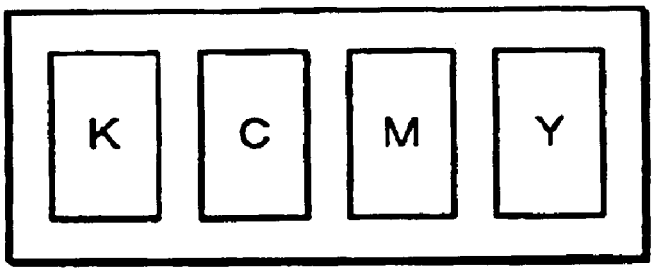
FIG. 11 CONVENTIONAL ART
FIG. 11 is a schematic plan view showing a conventional arrangement of ink heads in an ink head section in a carriage.
Figure 12:
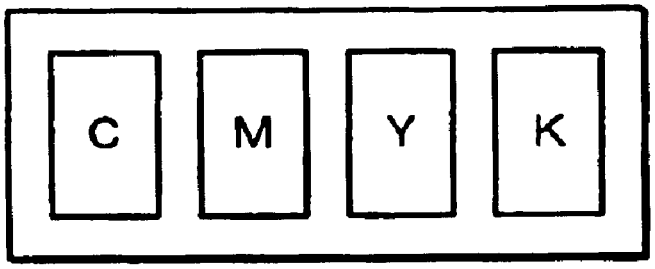
FIG. 12 CONVENTIONAL ART
FIG. 12 is a schematic plan view showing another conventional arrangement of ink heads in an ink head section in a carriage.

Here, to compare with the above arrangement, explained below is a case where printing is carried out on a recording medium to form a black image by employing a conventional arrangement of an ink head section, as shown in FIG. 11. In the conventional arrangement, a black ink head (K), a cyan ink head (C), a magenta ink head (M) and a yellow ink head (Y) are arranged in this order. In short, only one end of the order, with respect to the scanning direction, is the black ink head (K). Here, a black ink having inferior drying and penetrating properties and the color inks having superior drying and penetrating properties are overprinted so as to improve the result of the printing of the black ink in terms of the drying and penetrating properties with respect to the recording medium.

When the printing is carried out with the conventional arrangement of the ink head section in which the carriage scans in one way in the scanning direction, so that the yellow ink head (Y) is first in the order, the black ink is printed after a mixed color of a yellow ink, a magenta ink, and a cyan ink is printed. In addition, when the printing is carried out by the carriage scanning in the another way in the scanning direction, so that the black ink head (K) is first in the order, the mixed color of a yellow ink, a magenta ink, and a cyan ink is printed after the black ink is printed.

Figure 13:
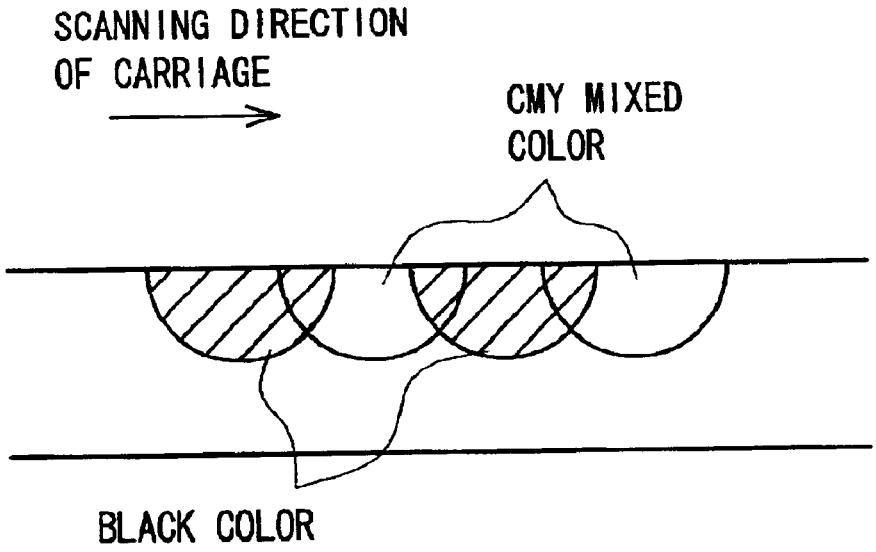
FIG. 13 is a cross-sectional view of a recording medium, illustrating how inks penetrate into the recording medium when the printing is carried out by a carriage, which is provided with an ink head section having the arrangement of the ink heads shown in FIG. 11, scanning in such a way in a scanning direction that a yellow ink head is first in an order of the ink heads.
Figure 14:
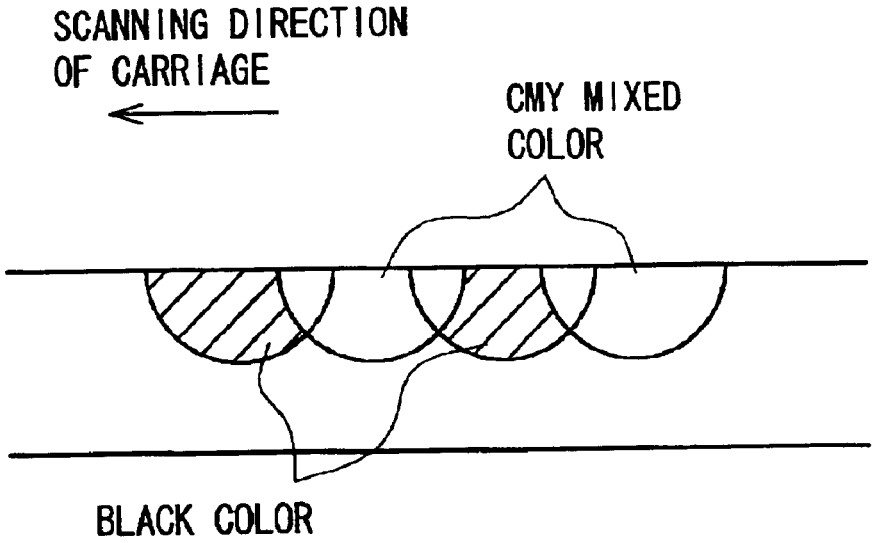
FIG. 14 is a cross-sectional view of a recording medium, illustrating how inks penetrate into the recording medium when the printing is carried out by a carriage, which is provided with an ink head section having the arrangement of the ink heads shown in FIG. 11, scanning in such a way in the scanning direction that a black ink head is first in an order of the ink heads.

Shown in FIG. 13 is how inks penetrate into the recording medium when the printing is carried out by a carriage scanning in the one way in the scanning direction in which a yellow ink head (Y) is first in the order. Here, the black ink (shaded portions in FIG. 13) is printed after the mixed color of the color inks (CMY mixed color) is printed. Thus, the black ink overlaps on the mixed color of the color inks. Meanwhile, FIG. 14 illustrates how inks penetrate into the recording medium when the printing is carried out by a carriage scanning in the one way in the scanning direction so that a black ink head (K) is first in the order. Here, on contrary to the case where the printing is done by a carriage scanning in the one way in the scanning direction that a yellow ink head (Y) is first in the order, the mixed color of the color inks overlaps on the black ink.

Figure 15:
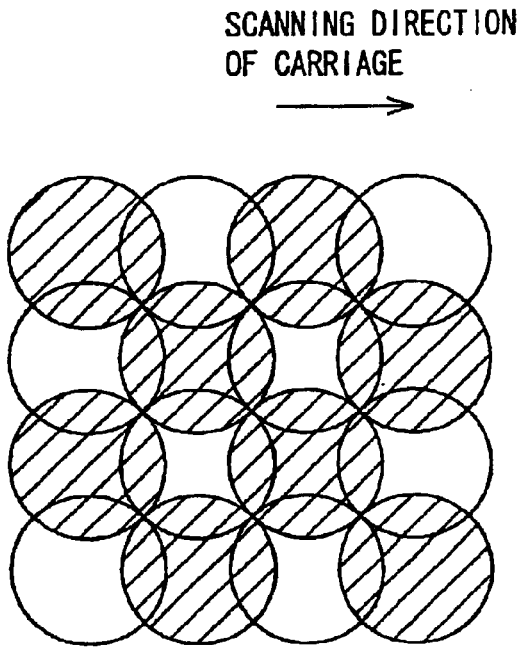
FIG. 15 CONVENTIONAL ART
FIG. 15 is a plan view of a recording medium, illustrating a condition of the inks on a surface of the recording medium when the printing is carried out by a carriage, which is provided with an ink head section having the arrangement of the ink heads shown in FIG. 11, scanning in such a way in the scanning direction that a yellow ink head is first in an order of the ink heads.
Figure 16:
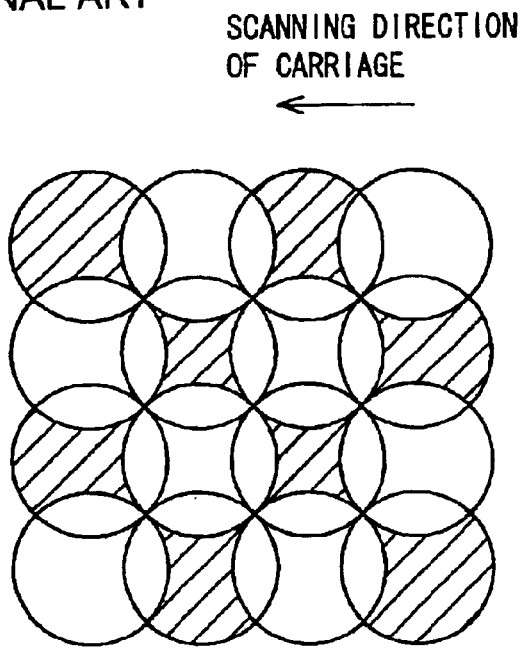
FIG. 16 CONVENTIONAL ART
FIG. 16 is a plan view of a recording medium, illustrating a condition of the inks on a surface of the recording medium when the printing is carried out by a carriage, which is provided with an ink head section having the arrangement of the ink heads shown in FIG. 11, scanning in such a way in a scanning direction that a black ink head is first in an order of the ink heads.
Figure 17:
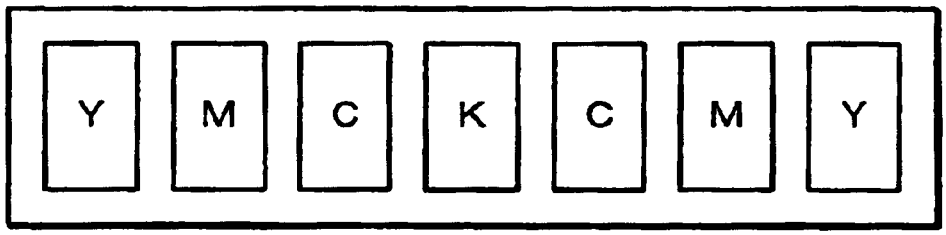
FIG. 17 CONVENTIONAL ART
FIG. 17 is a schematic plan view showing still another conventional arrangement of ink heads in an ink head section in a carriage.

In FIG. 15, illustrated is a condition on the surface of the recording medium when the inks penetrate into the recording medium as shown in FIG. 13. Meanwhile, FIG. 16 shows a condition on the surface of the recording medium when the inks penetrate into the recording medium as shown in FIG. 14. As shown in FIG. 15, when the printing is carried out by the carriage scanning in the one way in the scanning direction so that a yellow ink head (Y) is first in the order, the black ink is printed after the mixed color of the color inks is printed. Therefore, attained is a large area of the regions where the black ink is exposed on the surface of the recording medium, thereby eliminating the region where the color inks overlap on the black ink. On the other hand, as shown in FIG. 16, when the printing is carried out by the carriage scanning in the one way in the scanning direction so that a black ink head (K) is first in the order, the mixed color of the color inks after the black ink is printed. Therefore, the mixed color of the color inks overlap on the black ink, thereby making smaller the area of the regions where the black ink is exposed on the recording medium.

When the conventional arrangement of the ink head section is employed as above in order to form the black image, the area of the regions where the black ink is exposed on the recording medium is significantly different, depending on which way the carriage scans in the scanning direction. Moreover, the area of the region in which the color inks overlap on the black inks, is significantly different, depending on which way the carriage scans in the scanning direction. For this reason, if the printing is performed by the carriage scanning in the two ways in the scanning direction, it is possible to see a difference in the blackness between each scan of the carriage in the formed image, thus the image is of bad quality.

As to the image forming apparatus of an ink-jet type of the present invention, it is preferred that the black ink heads sandwiching the color ink head are respectively located in positions respectively shifted from a position of the color ink head in opposite ways in a direction vertical to a scanning direction.

The above arrangement makes it possible to print on the recording medium in such a manner that black ink is printed in positions respectively shifted from a position of the color ink in opposite ways in a direction vertical to a scanning direction, in every scan of the carriage. As a result, resolution of the black image formed on the recording medium is improved. Therefore, it is possible to provide an image forming apparatus that forms a high-quality image having high resolution.

As to the image forming apparatus of an ink-jet type of the present invention, it is preferable that the black ink heads sandwiching the color ink head are respectively located in positions respectively shifted so as to have a distance, which is equivalent to ½ of a nozzle pitch, between respective the black ink heads.

The above arrangement makes it possible to print on the recording medium in such a manner that the black ink, which can be described that the black ink is twice as much as the nozzle pitch, is printed in positions shifted from a position, where the color ink is printed, in a direction vertical to a scanning direction.

As to the image forming method of an ink-jet type of the present invention, it is preferable that the two black inks are printed in position shifted from a position of the color ink respectively in opposite ways in a direction vertical to a scanning direction.

The above arrangement makes it possible to print on the recording in such a manner that the black inks are printed in positions respectively shifted from the position where the color ink is printed, in opposite ways in a direction vertical to a scanning direction, in every scan of the carriage. As a result, the resolution of the black image formed on the recording medium is improved.

As to the image forming method of the present invention, it is preferable that the two black inks are respectively printed in positions respectively shifted only as much as ½ of a nozzle pitch.

The above arrangement makes it possible to print on the recording medium in such a manner that the black ink, which can be described that the black ink is twice as much as the nozzle pitch, is printed in positions shifted from a position, where the color ink is printed, in a direction vertical to a scanning direction.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus of an ink-jet comprising:

an ink head section whose carriage to scan for printing is composed of a plurality of ink heads, wherein said ink head section includes black ink heads and a color ink head in such a manner that said black ink heads sandwich said color ink head with respect to the scanning direction;

said color ink heads are disposed between said black color ink heads, so that only one color ink head is provided for each color, and each one of the ink heads is in direct physical contact with an ink head adjacent to it, wherein said black ink heads sandwiching said color ink head are respectively located in positions respectively shifted from a position of said color ink head in opposite ways in a direction vertical to a scanning direction.

2. An image forming apparatus of an ink-jet type, which includes an ink head section whose carriage to scan for printing is composed of a plurality of ink heads, wherein said ink head section includes black ink heads and a color ink head in such a manner that said black ink heads sandwich said color ink head with respect to the scanning direction, wherein said black ink heads sandwiching said color ink head are respectively located in positions respectively shifted from a position of said color ink head in opposite ways in a direction vertical to a scanning direction.

3. The image forming apparatus as set forth in claim 2, wherein said black ink heads sandwiching said color ink head are respectively located in positions respectively shifted, so as to have a distance, which is equivalent to ½ of a nozzle pitch, between respective said black ink heads.

4. The image apparatus as set forth in claim 2, wherein said black ink heads sandwiching said color ink head are located in positions respectively shifted from said position of said color ink head only as much as ¼ of a nozzle pitch.

5. The image forming apparatus as set forth in claim 1, wherein said color ink head is composed of a cyan ink head, a magenta ink head, and a yellow ink head.

6. An image forming method of an ink-jet:

providing a carriage, which has an ink head section composed of a plurality of ink heads, scans for printing, wherein said ink head section includes black ink heads and a color ink head in such a manner that said black ink heads are disposed so as to sandwich said color ink head, and said color ink heads are disposed between said black color ink heads in such a manner that only one color ink head is provided for each color, so that said ink head section prints in sequence a black ink, a color ink, and black ink, and each of the ink heads is placed in direct physical contact with an adjacent ink head, wherein said black ink heads sandwiching said color ink head are respectively located in positions respectively shifted from a position of said color ink head in opposite ways in a direction vertical to a scanning direction.

7. The image forming method as set forth in claim 6, wherein said carriage scans in two ways so as to print.

8. An image forming method of an ink-jet type in which a carriage, which has an ink head section composed of a plurality of ink heads, scans for printing, wherein said ink head section includes black ink heads and a color ink head in such a manner that said black ink heads are disposed so as to sandwich said color ink head, so that said ink head section prints a black ink, a color ink, and black ink in this order, wherein said two black ink heads are placed in position shifted from a position of said color ink respectively in opposite ways in a direction vertical to a scanning direction.

9. The image forming method as set forth in claim 8, wherein said two black ink heads are respectively placed in positions respectively shifted only as much as ½ of a nozzle pitch.

10. The image forming method as set forth in claim 8, wherein said two black ink heads are placed in positions respectively shifted from positions of said color ink head only as much as ¼ of a nozzle pitch.

11. An ink-jet forming method comprising:

providing a carriage, which has an ink head section composed of a plurality of ink heads that scans in a first and second direction for printing, said ink head section includes black ink heads and a color ink head in such a manner that said black ink heads are disposed so as to sandwich said color ink head, so that said ink head section prints a black ink, a color ink, and black ink in this order, wherein said color ink is overprinted on said black ink; and the overprinting is carried out so that each region where the black ink and the color ink, which are aligned lengthwise, overlap one another has an equal area in each scan direction of said carriage.

12. The image forming method as set forth in claim 11, wherein said color ink is at least one of a cyan ink, a magenta ink, and a yellow ink, wherein said cyan ink, said magenta ink and said yellow ink are overprinted on each other.

* * * * *